US007179371B1

(12) United States Patent
Bistline

(10) Patent No.: US 7,179,371 B1
(45) Date of Patent: Feb. 20, 2007

(54) SECURABLE CURB INLET FILTER

(76) Inventor: Thomas Nesbitt Bistline, 33002 Palo Alto St., Dana Point, CA (US) 92629

( * ) Notice: Subject to any disclaimer, the term of this patent is extended or adjusted under 35 U.S.C. 154(b) by 31 days.

(21) Appl. No.: 11/037,950

(22) Filed: Jan. 19, 2005

(51) Int. Cl.
*E03F 5/06* (2006.01)

(52) U.S. Cl. ..... 210/163; 210/473; 210/232; 404/4

(58) Field of Classification Search ..... 210/163, 210/164, 232, 473, 474; 404/4, 5
See application file for complete search history.

(56) References Cited

U.S. PATENT DOCUMENTS

| | | | | | |
|---|---|---|---|---|---|
| 791,381 | A * | 5/1905 | Thompson | 210/164 |
| 1,654,886 | A * | 1/1928 | Keeble et al. | 210/163 |
| 3,945,746 | A * | 3/1976 | Bredbenner | 210/163 |
| 4,126,404 | A * | 11/1978 | Ferns | 210/163 |
| 4,594,157 | A * | 6/1986 | McGowan | 210/163 |
| 5,324,135 | A * | 6/1994 | Smith | 210/164 |
| 5,954,952 | A * | 9/1999 | Strawser, Sr. | 210/164 |
| 6,015,489 | A * | 1/2000 | Allen et al. | 210/163 |
| 6,214,216 | B1 * | 4/2001 | Isaacson | 210/163 |
| 6,709,579 | B1 | 3/2004 | Singleton et al. | |
| 6,974,540 | B1 * | 12/2005 | Fleischmann | 210/163 |
| 2002/0130083 | A1 * | 9/2002 | Middleton et al. | 210/163 |
| 2003/0147693 | A1 * | 8/2003 | Knak et al. | 404/4 |
| 2003/0173277 | A1 * | 9/2003 | Shaw et al. | 210/163 |

* cited by examiner

*Primary Examiner*—Christopher Upton
(74) *Attorney, Agent, or Firm*—Thomas Thibault

(57) ABSTRACT

An apparatus for construction site erosion control for temporarily enclosing the curb inlet of a storm drainage system during construction of a road system in commercial and residential developments is adapted to be placed adjacent a curb inlet of a storm drain in order to enable storm water runoff to drain into the inlet while preventing silt and debris from being carried into and collected therein. The apparatus includes a grate constructed to seat upon an open end of a storm drain inlet, means for filtering debris from storm water runoff passing through the means and through the grate, into the storm drain inlet; and means for securing the grate to a storm drain protection bar.

11 Claims, 6 Drawing Sheets

SECURABLE CURB INLET FILTER

BACKGROUND

1. Field

The present invention generally relates to devices for filtration of water entering storm water drainage systems through a roadway curb opening, and in particular to a barrier filter for a curb inlet of a storm water drainage system adapted to filter silt and debris from storm water passing through the curb inlet and into the storm water drainage system.

2. Description of the Related Art

In the construction of streets, highways, residential housing developments, commercial developments, schools, airports and similar other types of construction projects, the road system generally is first marked out and the streets of the development are cleared and graded. Thereafter, the storm water drainage system for the development is constructed, which typically includes the underground drainage pipes, collection basins, culverts, and drop inlets that form the connection between the storm water drainage system and the finished street side curb inlet.

The storm water drainage system connected to the curb inlets must be kept substantially free of silt and sediment during the remaining phases of construction, pursuant federal, state and local clean water regulations and building codes. Keeping silt and sediment out of the collection basins is, however, difficult given additional grading on site wherein silt and sediment tends to remain unstable and easily migrates towards the sides of the street by wind, water and construction activity and consequently into the open curb inlets. If silt and sediment are washed into or otherwise collected within the collection basins and/or other parts of the drainage system, the collection basins can become clogged and it becomes necessary to send workers down into the collection boxes to manually clean out the dirt and/or debris that has been washed or accidentally dropped into the collection basins to comply with clean water regulations. Such cleaning operations are difficult as the pipes are somewhat cramped, making it difficult to maneuver, and there is also the danger of cave-ins or collapses of the silt, sediment, dirt, and etc. that has built up around the sides of the collection basins, creating a significant risk of injury or even death to the workers below, as well as the negative environmental impact and clean water regulation violations from the migrating sediment.

Although the simplest solution to this problem would seem to be to completely seal the curb inlet, this solution is not feasible as storm water must be permitted to drain through the drainage system of the development during construction to permit the ground to dry and to prevent storm water from eroding the work site and carrying soil and debris to adjacent lots, buildings or state waters. The streets and roadways must also be kept clear to prevent a potential traffic hazard from standing water.

In the past, various filter systems for protecting the curb inlets of the storm water drainage system have been utilized. Unfortunately, most of these systems have suffered from various disadvantages, including lack of portability and ineffective anchoring to maintain the filter system in place during heavy flows of storm water. Such systems include weir arrangements constructed of gravel supported by a wire screen and the like; rolled bundles of filter material, such as coir wattle; arrangements of cinder blocks loosely wrapped with geotextile fence material and arrangements of filtering rocks contained within loosely woven cloth, these latter two arrangements being commonly referred to as "pigs-in-a-blanket." These types of filter systems, however, often tend to be either difficult to transport and deploy or, after being deployed, tend to be insufficiently stable to maintain their position in the face of rushing water, wind or other forces and do not meet current clean water regulations.

Accordingly, it can be seen that a need exists for a system for covering and protecting curb inlets of a storm water collection basin of a drainage system to prevent silt and sediment from migrating into the inlet while still allowing for the free and substantially complete drainage of storm water runoff into the curb inlet.

SUMMARY

The present invention is directed to a securable curb inlet filter used to filter storm water runoff from construction sites, or any other land area served by a storm drain system. In one embodiment, the securable curb inlet filter comprises a grate constructed to seat upon an open end of a storm drain inlet for filtering debris from storm water runoff passing through the grate, into the storm drain inlet, and means for securing the grate to a storm drain protection bar. In one embodiment, the means for securing the grate to the storm drain protection bar comprises a rigid extension, a first end of the rigid extension mounted perpendicularly to the grate and a second end of the rigid extension comprising grasping means for securing the grate to the storm drain protection bar. The grasping means prevents the curb inlet filter from becoming dislodged from the storm drain inlet during periods of heavy precipitation.

BRIEF DESCRIPTION OF THE DRAWINGS

The foregoing aspects and the attendant advantages of the embodiments described herein will become more readily apparent by reference to the following detailed description when taken in conjunction with the accompanying drawings wherein.

DETAILED DESCRIPTION

The following detailed description describes a securable curb inlet filter used generally for construction site erosion control. While the embodiments described herein relate to erosion control around construction sites, the apparatus could be used in other applications, for example, filtering storm water runoff in any storm drain during heavy rains, floods, or other inclement weather.

Figure 1:
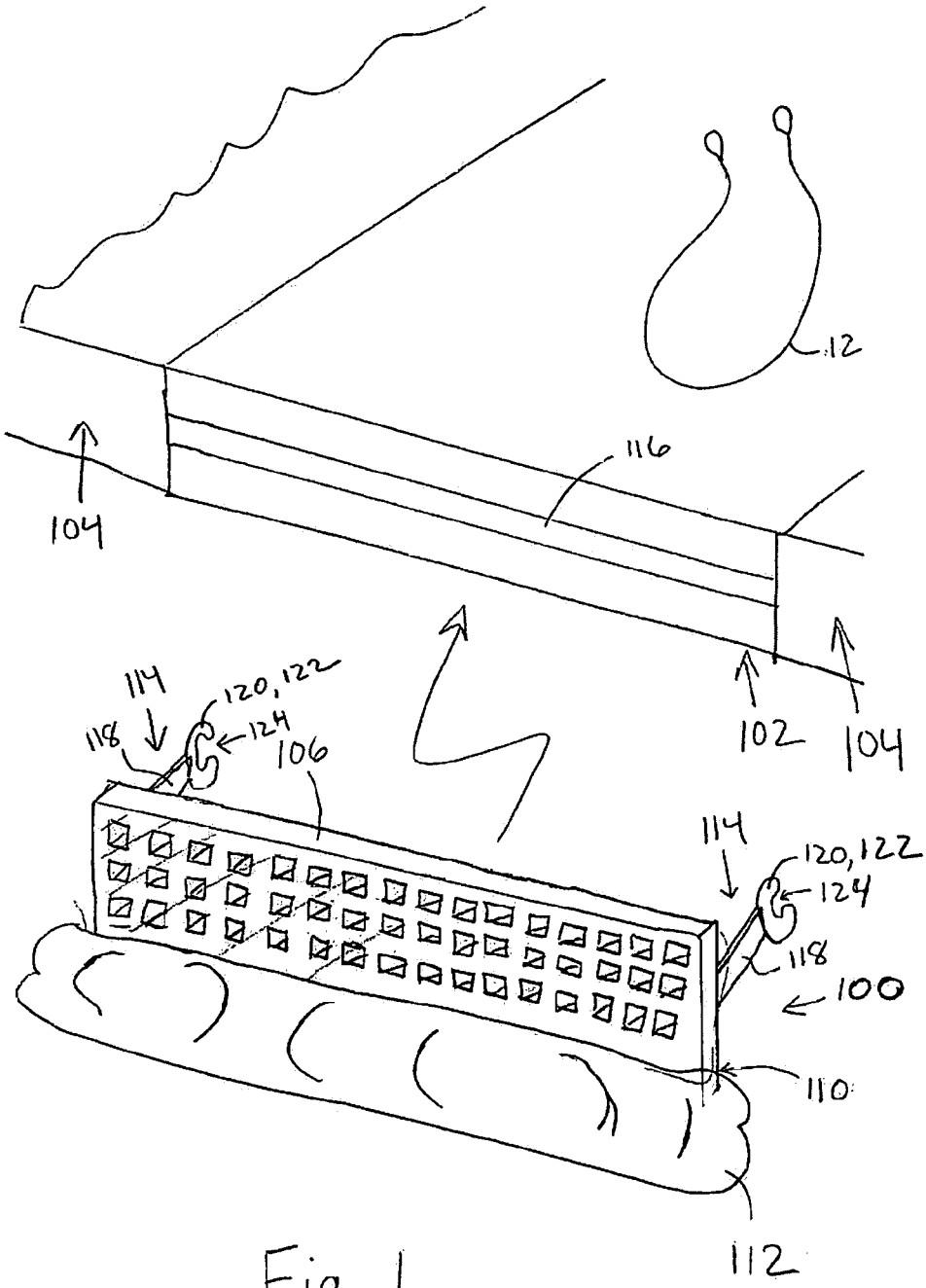
FIG. 1 illustrates a three-quarter view of one embodiment of a securable curb inlet filter.

FIG. 1 illustrates a three-quarter view of one embodiment of a securable curb inlet filter for construction site erosion control. The securable curb inlet filter 100 generally is designed for temporarily covering and protecting a curb inlet 102 of a storm water drainage system, typically during construction taking place nearby so as to filter storm water runoff passing through the curb inlet and into the storm water drainage system and to prevent silt and debris from collecting within the underground pipes and collection boxes of the drainage system. Typically, the storm water drainage system will include underground concrete or metal drainage pipes and/or collection basins (not shown), with one or more curb inlets 102 mounted thereto.

The curb inlet 102 of a storm water drainage system typically includes a sloped mouth leading from the curb 104 and emptying into a catch basin (not shown). The curb inlet 102 takes in storm water and other excess runoff water from the adjacent roadway and site area so as to aid in storm water runoff drainage and to reduce the likelihood of flooding. During nearby construction, the presence of construction-related silt and debris increases the possibility that storm water runoff will carry such material into the storm water drainage system through the curb inlets 102. The securable curb inlet filter 100 generally is positioned adjacent the curb inlet, so as to filter storm water runoff passing into the curb inlet and substantially prevent silt and debris from entering the curb inlet 102 but while still allowing water to flow into the curb inlet.

The securable curb inlet filter 100 generally includes an elongated grate 106 that may be rectangular, square, trapezoidal, triangular or any other convenient shape as desired or necessary for substantially covering and filtering the curb inlet 102. Grate 106 comprises perforations which allow water to flow through grate 106 while preventing large debris from entering the storm water drainage system. The perforations may be square, rectangular, circular, triangular, or virtually any other shape, or even a combination of shapes. In one embodiment, the perforations are square, measuring approximately 1.5 inches square. Grate 106 may be constructed of plastic, fiberglass, wood, metal, a plastic-fiberglass composite, or any other suitable material. The length and width of grate 106 will depend on the length and width of a storm drain opening to be protected. Grate 106 may be constructed using any suitable means known in the art, including injection molding, mold-pouring, constructing individual "slats" and then joining the slats to form the shape of grate 106, or by other means.

In one embodiment, securable curb inlet filter 100 may additionally comprise a filter fabric 108. The filter fabric 108 substantially covers or encapsulates grate 106, and provides for finer filtration than would otherwise be possible by using grate 106 alone. The filter fabric 108 may include a geosynthetic material or similar mesh or fabric filtering material. As used herein, the term "geotextile" refers to any woven or non-woven synthetic filter material that may act to separate, reinforce, filter, drain, or serve as a moisture barrier. Examples of the materials that can be used as the filter medium include silt screen materials, mesh materials, wire screens, polyesters, nylons, polyvinyl chlorides or woven fiber blankets, such as formed from cotton or coconut fibers, or other synthetic or natural screening material, or any other suitable material that can effectively filter silt and debris from water.

Returning to FIG. 1, attached to a bottom edge 110 of grate 106 is a weighted anchor bag 112. The anchor bag 112 serves to filter fine sediment from entering the curb inlet 102 and also helps prevent movement of the curb inlet filter 100 after installation. Another advantage of using anchor bag 112 is that it conforms to any variations in the concrete flow line leading to the curb inlet 102. The anchor bag 112 may be formed as a part of the filter fabric 108, or it may be constructed as a separate unit, and then attached to bottom edge 110 of the grate 106 by fasteners, such as, for example, ties, hooks, staples and the like. Anchor bag 112 is typically formed by filling a long, cylindrically-shaped bag with a weighted material, such as any loose material that may be readily available at a construction site, such as, for example, rock, dirt, sand, concrete, and combinations thereof, and is placed into the bag just prior to use and then emptied after use, so as to facilitate transport of the curb inlet filter 100. The ends of the bag may be closed off by twisting the filter medium material and clamping or securing the ends closed with fasteners, such as, for example, ties, clamps, staples and the like.

Figure 2A:
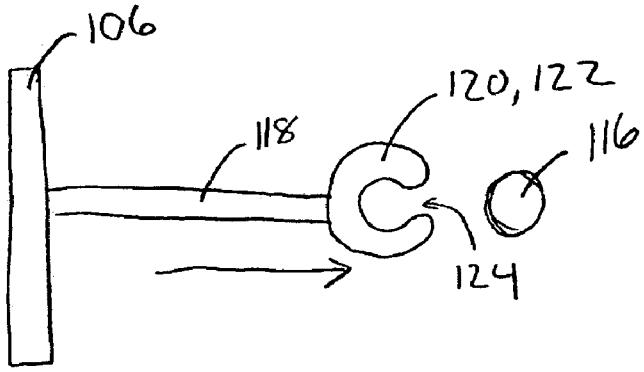
FIGS. 2*a* through 2*d* show how the securable curb inlet filter of FIG. 1 is secured to a bar within a curb inlet.
Figure 2B:
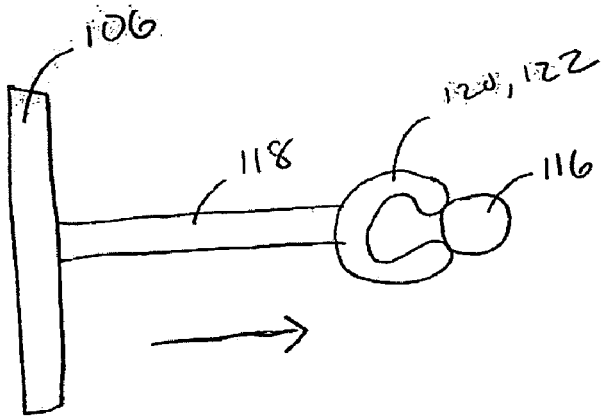
Figure 2C:
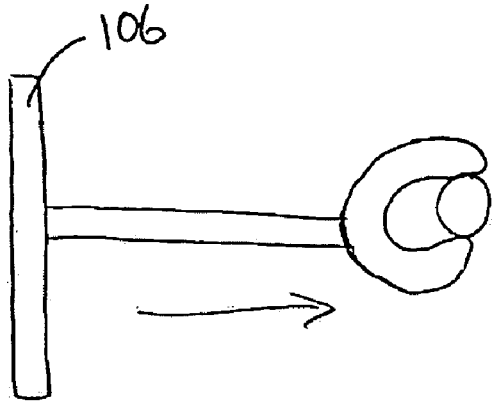
Figure 2D:
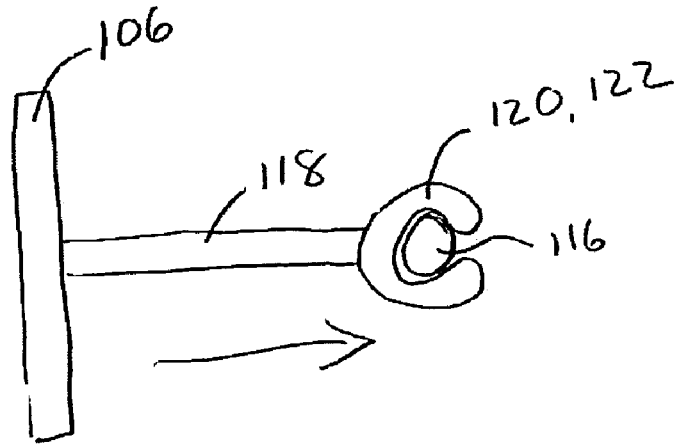

Securable curb inlet filter 100 additionally comprises at least one means for securing securable curb inlet filter 100 to a curb inlet 102, in this embodiment, shown as extension 114. Extension 114 serves to secure securable curb inlet filter 100 to curb inlet 102 by encapsulating, capturing, grasping, or otherwise attaching to, a portion of a bar 116 during installation of securable curb inlet filter 100 to curb inlet 102. Extension 114 comprises a rigid member 118, having a first end mounted perpendicularly to grate 106 and having grasping means 120 located at the opposing end. Grasping means 120 comprises, in one embodiment, a semi-circular element 122, having an opening 124 smaller than a diameter of bar 116. It should be understood that grasping means 120 could alternatively comprise virtually any shape other than a semi-circle. Semi-circular element 122 is constructed of plastic, metal, or any other rigid or semi-rigid material having material properties which allow for some deformation of semi-circular element 122. For example, as extension 114 moves toward bar 116 (FIG. 2*a*) and eventually contacts bar 116 (FIG. 2*b*), bar 116 operates on semi-circular element 122, forcing opening 124 to become greater as extension 114 is moved further towards bar 116. Eventually, opening 124 becomes equal to the diameter of bar 116 (FIG. 2*c*). Finally, as extension 114 moves even further towards bar 116, bar 116 becomes encapsulated by semi-circular element 122, and opening 124 decreases back to its original spacing due to the deformative property of the material comprising semi-circular element 122 (FIG. 2*d*). The bar 116 is then "captured" by semi-circular element 122, thereby preventing the securable curb inlet filter 100 from being easily removed from the curb inlet 102. However, the securable curb inlet filter 100 may be removed by applying a force away from bar 116 enough to cause bar 116 to again operate on semi-circular element 122, this time in the opposite direction as described with respect to FIG. 2. At some point, a force is great enough so that bar 116 slides through opening 124, allowing securable curb inlet filter 100 to be removed.

The material comprising semi-circular element 122, the distance of opening 124 in an unforced, or quiescent, state, the general size and shape of grasping means 120, and the diameter of bar 116 may be considered in determining how much force is required to capture and release securable curb inlet filter 100. For example, in an application where no or little rain is expected, the opening 124 may be chosen so that it is just slightly smaller than the diameter of bar 116, thereby requiring a small force against grate 106 to secure and release securable curb inlet filer 100 from bar 116. However, if heavy rain is expected, the opening 124 may be chosen so that it is very much smaller than the diameter of bar 116, thereby requiring a large force against grate 106 to secure and release securable curb inlet filer 100 from bar 116.

In one embodiment, securable curb inlet filter 100 comprises two extensions 114, located along a horizontal axis of grate 106. A greater or fewer number of extensions 114 may be used in the alternative. If two extensions are used, they are generally located at or near the vertical edges of grate 106. Generally, when using more than one extension, they are equally spaced apart from each other. Each extension 114 may be mounted to grate 106 in any conventional manner. For example, the first end of extension 114 may comprise threads which are then screwed into a threaded hole or insert located on grate 106 during assembly.

In some embodiments, bar 116 does not run horizontally across curb inlet 102. In some instances, curb inlet 102 comprises one or more vertical bars 116. In this case, the grasping means at the end of extension 114 will have to be rotated 90 degrees in order to receive the vertical bars. This may be accomplished in any number of ways. For example, the first end of extension 114 may be rotatable within the means for securing the first end to grate 106. For instance, if the first end of extension 114 is screwed into a threaded hole located on grate 106, then the entire extension 114 may generally be rotated either clockwise or counter-clockwise within the threaded hole, thereby rotating the grasping means located on the other end of extension 114 by 90 degrees. In another embodiment, the first end of extension 114 is fixed with respect to grate 106, however, the grasping means is rotatably connected to rigid member 118. This allows the grasping means to rotate to any angle necessary to receive bar 116, whether bar 116 is located horizontally or vertically within curb inlet 102.

Figure 3:
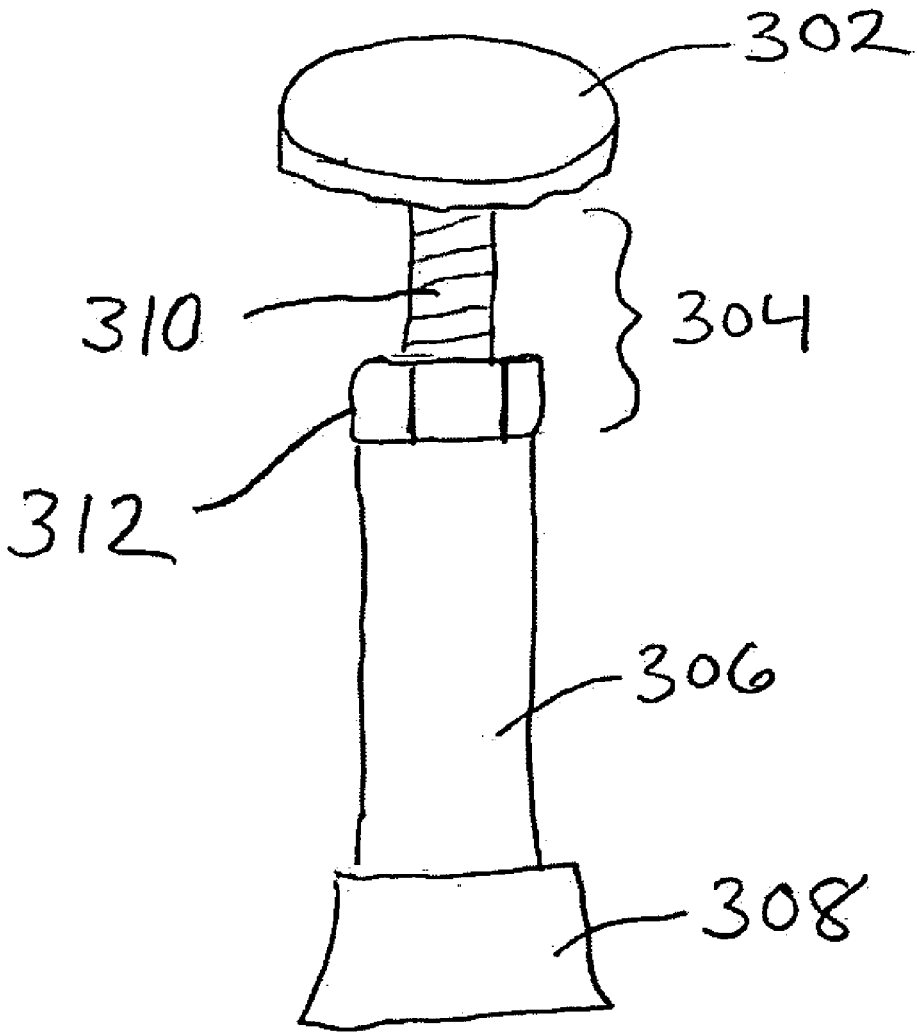
FIG. 3 illustrates an "artificial" protection bar for use when no protection bar is present in a curb inlet.

FIG. 3 illustrates an "artificial" protection bar 300 for use when no protection bar is present in a curb inlet. In this case, one or more artificial protection bars 300 are first installed into curb inlet 102 prior to placement of curb inlet filter 100. Then the curb inlet filter 100 is installed, using the one or more artificial protection bars to secure to. The artificial protection bar 300 is sized to fit either horizontally or vertically within curb inlet 100.

As shown in FIG. 3, artificial protection bar 300 comprises a pad 302, adjustment means 304, body 306, and tip 308. It should be understood that artificial protection bar 300 could be constructed a fewer components, such as dispensing with tip 308 and/or pad 302. Pad 302 and tip 308 are may be constructed of any rigid or semi-rigid material, however, a materiel that possesses a high coefficient of friction is an ideal choice, such as rubber, for preventing movement of artificial protection bar 300 while it is installed in place. Artificial protection bar 300 may be adjusted in height using adjustment means 304, which, in the embodiment shown in FIG. 3, comprises threaded member 310 and lock nut 312. Threaded member 310 screws into lock nut 312 and into body 306, which is either partially or wholly hollow. As threaded member 310 is screwed into lock nut 312, the overall height of artificial protection bar is decreased. Similarly, when threaded member 310 is backed out of lock nut 312, the overall height of artificial protection bar 300 is increased. Other variations of adjustment means 304 are possible, such as body 306 comprising internal threads, wherein threaded member 310 screws into these threads, either in addition, or alternatively, to screwing into lock nut 312.

In use, artificial protection bar 300's height is adjusted to be slightly less than the height of curb inlet filter 102 (or width, if artificial protection bar 300 is used horizontally in curb inlet filter 100. Artificial protection bar 300 is then placed inside curb inlet 102 and then the height of artificial protection bar 300 is increased by using adjustment means 304, forcing pad 302 to contact an upper surface of curb inlet 102. The height of artificial protection bar 300 is further increased slightly, wedging artificial protection bar 300 into curb inlet 102. One or more artificial protection bars 300 may be then similarly installed, as needed. Then, curb inlet filter 100 is installed onto the one or more artificial protection bar(s) 300 as if installing onto a pre-existing protection bar 116.

In one embodiment, curb inlet filter 100 additionally comprises theft-prevention means 126 for preventing unauthorized removal of curb inlet filter 100. In one embodiment, theft-prevention means 126 comprises a length of metal cable placed through one of the openings on grate 106 and around the protection bar 116. A standard key or combination lock may then be used to secure the two ends of the cable.

Figure 4:
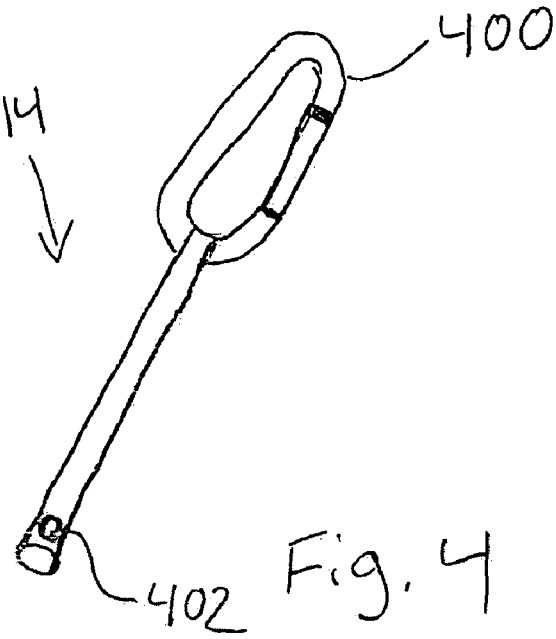
FIG. 4 illustrates one embodiment of a theft prevention means.

In another embodiment, theft prevention means 126 is embodied into extension 114, as shown in FIG. 4. In this embodiment, Extension 114 comprises a latch 400, such as a carabiner, connected to one end of extension 114. Latch 400 is used to secure extension 114 to protection bar 116. Then, grate 106 is then placed against curb inlet 102, where the other end of extension 114 protrudes through either a grate opening, or a dedicated hole formed within grate 106. A lock, such as a key lock or a combination lock, is then used to prevent grate 106 from disengaging extension 114 by placing a shackle of the lock through a hole 402 formed in the second end of extension 114 and then closing the lock.

Figure 5:
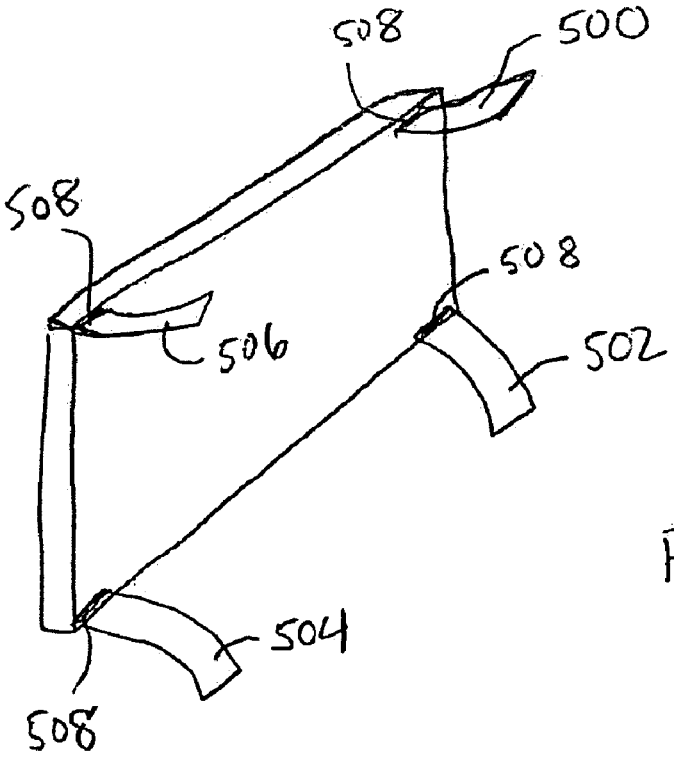
FIG. 5 illustrates another embodiment of the securable curb inlet filter.

FIG. 5 illustrates another embodiment of the securable curb inlet filter. This is a simplified drawing which omits the grate openings, anchor bag 112, or filter fabric 108. This drawing is meant to highlight tines 500, 502, 504, and 506, which are flat lengths of metal that are inserted into slots 508 formed within grate 106. In other embodiments, the material chosen for the times could be plastic, fiberglass, or other material. The tines are constructed of any material that will retain the general curved shape as shown in FIG. 5 after being deformed upon installation of grate 106 against curb inlet 102, as explained below.

In this embodiment, grate 106 is installed by bending tines 500 and 502 together, as well as tines 504 and 506 together. The tines are then inserted into curb inlet 102 and then released. The tines, having a spring-like characteristic, attempt to return to their original position. This action forces the tines against an inner surface of curb inlet 102, thereby securing curb inlet filter 100 in place. The curb inlet filter 100 is easily removed by pulling curb inlet filter 100 away from curb inlet 102 with enough force to overcome the retention caused by the tines against the inside surface of curb inlet 102.

Figure 6:
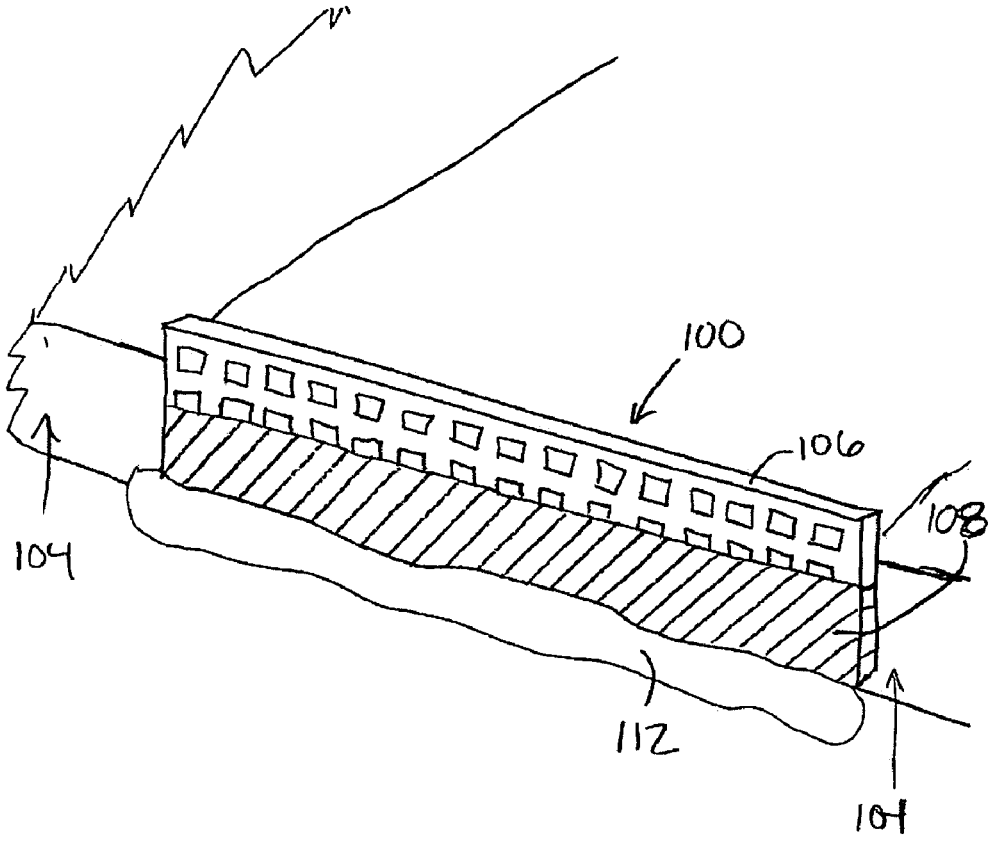
FIG. 6 illustrates the securable curb inlet filter of FIG. 1 or FIG. 5 in use.

In use, as illustrated in FIG. 6, securable curb inlet filter 100 is placed adjacent the mouth of curb inlet 102 with the one or more grasping means 120 adjacent to bar 116. FIG. 6 also illustrates filter fabric 108 installed onto grate 106, covering about one-half the height of grate 106. It should be understood that although the height of grate 106 exceeds the height of the curb inlet 106 as shown in FIG. 6, in other embodiments, the height of grate 106 may be equal to, or less than, the height of curb inlet 102.

After curb inlet filter 100 is positioned as described above, grate 106 is then pushed toward bar 116 until bar 116 is captured by grasping means 120. The extension(s) 114 secure the curb inlet filter 100 in position adjacent the curb inlet 102, even when the curb inlet filter 100 is buffeted by strong currents of storm water flowing toward the curb inlet 102. Water running towards curb inlet 102 encounters securable curb inlet filter 100 and passes over and through anchor bag 112, through filter fabric 108 (if used), and then flows through grate 106, into the curb inlet 102. A substantial portion of the silt and debris carried by the water is stopped by securable curb inlet filter 100 before it enters the curb inlet 102. This substantial portion of the silt and debris accumulates in and around securable curb inlet filter 100, but does not pass into the curb inlet 102. Anchor bag 112 generally helps provide stability and tend to further secure the curb inlet filter 100 in position adjacent the curb inlet 102. After use, the silt and debris that has collected in and around the curb inlet filter 100 is removed and the curb inlet filter cleaned. Thereafter, the weighted matter contained in anchor bag 112 is generally removed therefrom and/or the bags themselves are removed so that the curb inlet filter 100 can then be easily transported.

Accordingly, it can be seen that the present invention provides a unique, temporary barrier for protecting a curb inlet of a storm drainage system that can withstand the accompanying force of water passing therethrough and silt and sediment urged or collected thereagainst to prevent this silt and sediment from passing into the curb inlet, while still enabling storm water runoff to be drained from the site without the drainage system or adjacent streams or lots becoming clogged with eroded soil and construction debris.

The previous description of the preferred embodiments is provided to enable any person skilled in the art to make and use the present invention. The various modifications to these embodiments will be readily apparent to those skilled in the art, and the generic principles defined herein may be applied to other embodiments without the use of the inventive faculty. Thus, the present invention is not intended to be limited to the embodiments discussed herein, but is to be accorded the widest scope consistent with the principles and novel features disclosed herein.

I claim:

1. A securable curb inlet filter, comprising:

a grate constructed to seat upon an open end of a storm drain inlet for filtering debris from storm water runoff passing through the grate, into the storm drain inlet; and a rigid extension, a first end of the rigid extension mounted perpendicularly to the grate and a second end of the rigid extension comprising grasping means for securing the grate to a storm drain protection bar.

2. The apparatus of claim 1, further comprising a filter fabric connected to the grate, the filter fabric for filtering fine debris from the storm water runoff.

3. The apparatus of claim 1 further comprising a filter bag attached to a lower portion of the grate.

4. The apparatus of claim 1 wherein the grate comprises a framework of latticed bars.

5. The apparatus of claim 1, wherein the grasping means comprises a semi-circular element, the semicircular element comprising an opening smaller than a diameter of the storm drain protection bar when the semi-circular element is in a quiescent state.

6. The apparatus of claim 1, wherein the rigid extension is rotatable with respect to the grate.

7. The apparatus of claim 1, wherein the grasping means is rotatably connected to the rigid extension.

8. The apparatus of claim 1, further comprising an artificial protection bar for installation within the storm drain inlet when the protection bar is not present, wherein the securable curb inlet filter is secured to the storm drain inlet by connecting to the artificial protection bar.

9. The apparatus of claim 1 further comprising theft prevention means.

10. The apparatus of claim 9, wherein the theft prevention means comprises a length of cable having looped ends and a lock.

11. The apparatus of claim 9, wherein the theft prevention means comprises:

a latch;

a rigid extension, a first end of the rigid extension connected to the latch and a second end of the rigid extension comprising a hole sized and shaped to allow a shackle to pass therethrough.

* * * * *